US009173026B2

(12) United States Patent
Ohtsuka

(10) Patent No.: US 9,173,026 B2
(45) Date of Patent: Oct. 27, 2015

(54) SOUND RECORDING DEVICE

(71) Applicant: Panasonic Corporation, Osaka (JP)

(72) Inventor: Yoshio Ohtsuka, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 300 days.

(21) Appl. No.: 13/831,741

(22) Filed: Mar. 15, 2013

(65) Prior Publication Data

US 2013/0259262 A1 Oct. 3, 2013

(30) Foreign Application Priority Data

Mar. 27, 2012 (JP) ..... 2012-070812

(51) Int. Cl.
*H04R 3/00* (2006.01)
*H01R 107/00* (2006.01)

(52) U.S. Cl.
CPC ..... *H04R 3/005* (2013.01); *H04R 3/00* (2013.01); *H01R 2107/00* (2013.01); *H04R 2410/00* (2013.01); *H04R 2499/11* (2013.01)

(58) Field of Classification Search
None
See application file for complete search history.

(56) References Cited

U.S. PATENT DOCUMENTS

| | | | | |
|---|---|---|---|---|
| 7,890,284 | B2 * | 2/2011 | Patterson et al. | 702/117 |
| 2004/0264703 | A1 | 12/2004 | Fujita | |
| 2007/0164861 | A1 * | 7/2007 | Sano | 340/568.4 |
| 2007/0237340 | A1 * | 10/2007 | Pfanzagl-Cardone | 381/92 |
| 2012/0200172 | A1 * | 8/2012 | Johnson et al. | 307/116 |
| 2015/0110331 | A1 * | 4/2015 | Kwon et al. | 381/384 |

FOREIGN PATENT DOCUMENTS

| | | |
|---|---|---|
| JP | 3-295070 | 12/1991 |
| JP | 8-293159 | 11/1996 |
| JP | 2005-026868 | 1/2005 |
| JP | 2009-194890 | 8/2009 |

* cited by examiner

*Primary Examiner* — Wayne Young
*Assistant Examiner* — Mark Fischer
(74) *Attorney, Agent, or Firm* — Panasonic Patent Center

(57) ABSTRACT

A sound recording device of the present disclosure is can be connected with an external sound pickup device. The sound recording device includes a connector having a plurality of terminals to which the external sound pickup device can be connected, and a determiner that determines a type of the external sound pickup device when the external sound pickup device is connected to the connector, based on a correlation between signals of specific terminals out of the plurality of terminals.

8 Claims, 8 Drawing Sheets

SOUND RECORDING DEVICE

BACKGROUND

1. Technical Field

The present disclosure relates to a sound recording device to which an external microphone can be connected.

2. Related Art

There is known a sound recording device capable of being connected with an external microphone (external sound pickup device) and capable of picking up sound with the external microphone. JP-A-2009-194890 discloses a configuration for automatically determining types of plural kinds of audio apparatuses in such a sound recording device.

This conventional sound recording device determines a type of the audio apparatus based on impedances of channels of the audio apparatus such as the external microphone connected to a jack interface of the sound recording device. With this configuration, using only one jack interface, the sound recording device can be adapted to plural kinds of audio apparatuses.

SUMMARY

Such a conventional sound recording device determines a type based on the impedances of the channels of the connected external sound pickup device. In this case, the determination may not be appropriate.

The present disclosure provides a sound recording device capable of more appropriately determining a type of a connected external sound pickup device.

The sound recording device of the present disclosure is a sound recording device to which an external sound pickup device can be connected. The sound recording device includes a connector having a plurality of terminals to which the external sound pickup device can be connected, and a determiner that determines a type of the external sound pickup device when the external sound pickup device is connected to the connector, based on a correlation between signals of specific terminals of the plurality of terminals.

According to the present disclosure, a sound recording device capable of more appropriately determining a type of a connected external sound pickup device can be provided.

DETAILED DESCRIPTION OF PREFERRED EMBODIMENTS

Hereinafter, embodiments are described in detail with reference to the drawings as appropriate. However, a detailed description more than necessary may be omitted. For example, a detailed description of an already well-known matter and a duplicate description of a substantially identical configuration may be omitted. This is for the purpose of avoiding a subsequent unnecessary redundant description and facilitating the understanding of those skilled in the art.

The inventor(s) provide the appended drawings and the following description to enable those skilled in the art to fully understand the present disclosure, and do not intend to limit the subject described in claims by the drawings and the description.

First Embodiment

A digital camera of the first embodiment includes a jack for connecting an external microphone. When the external microphone is connected to the digital camera, the digital camera determines whether the connected external microphone is a dedicated microphone. A configuration and an operation of the digital camera are described below.

[1. Configuration]

A configuration of a digital camera 100 is described below with reference to the drawings.

[1-1. Configuration of the Digital Camera 100]

Figure 1:
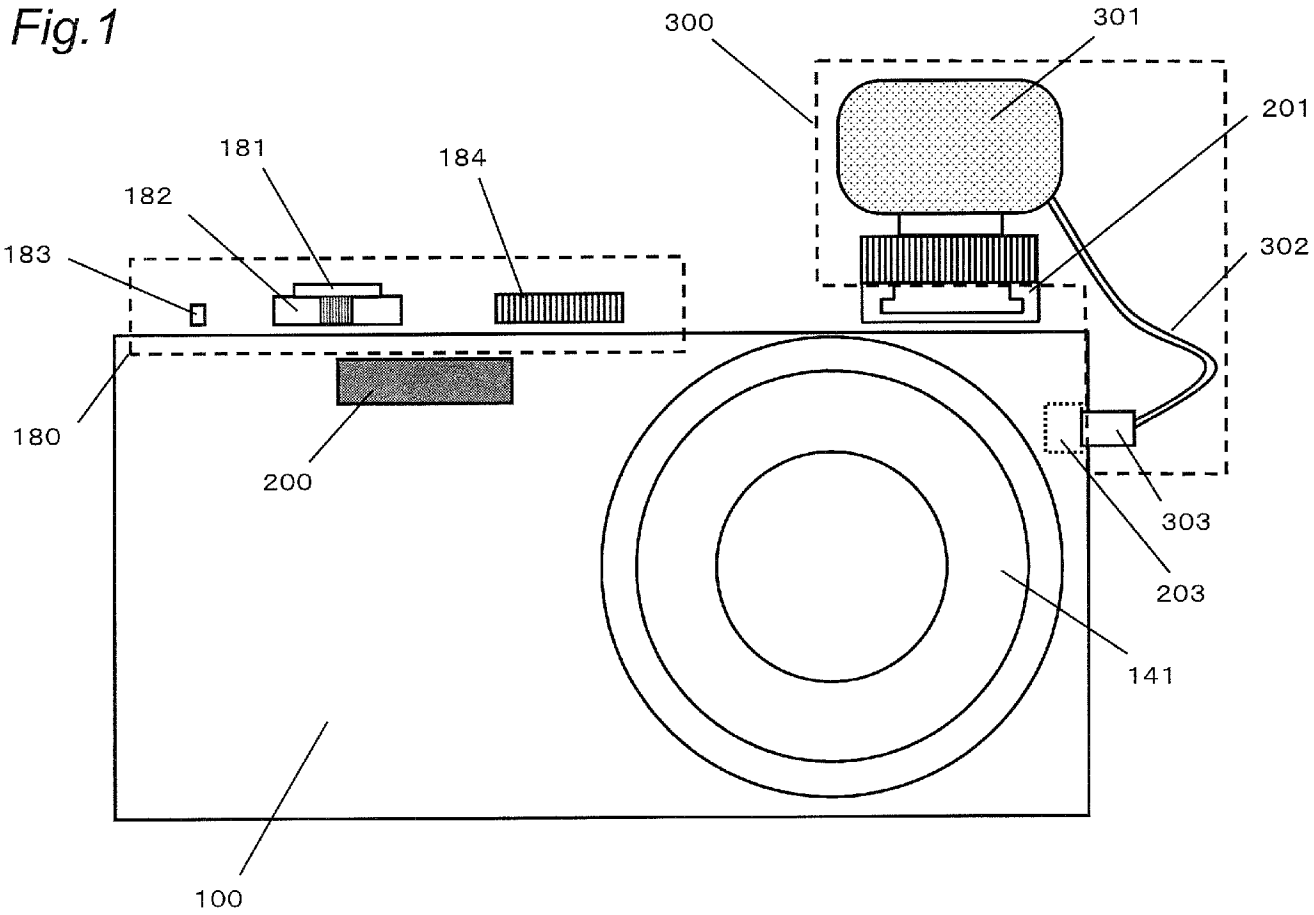
FIG. 1 is a front view of a digital camera according to a first embodiment.

FIG. 1 is a front view of the digital camera 100. The digital camera 100 includes a lens tube 141 and a flash 200, at the front. The digital camera 100 includes an operating unit 180 that has a release button 181, a zoom lever 182, a power button 183, a mode dial 184, and the like, and a shoe 201, on an upper surface of the digital camera 100. An external microphone 300 is mechanically and electrically connectable to the digital camera 100. The shoe 201 can mechanically fix the external microphone 300. The external microphone 300 includes a sound pickup unit 301, a cable 302 connected to the sound pickup unit 301, and a plug 303 to which the cable 302 is connected. The plug 303 is electrically connectable to a jack 203 provided on a side surface of the digital camera 100. A sound signal picked up by the sound pickup unit 301 of the external microphone 300 is input to an analog audio processor, a digital audio/video processor (described later) and the like of the digital camera 100, through the cable 302, the plug 303, and the jack 203.

Figure 2:
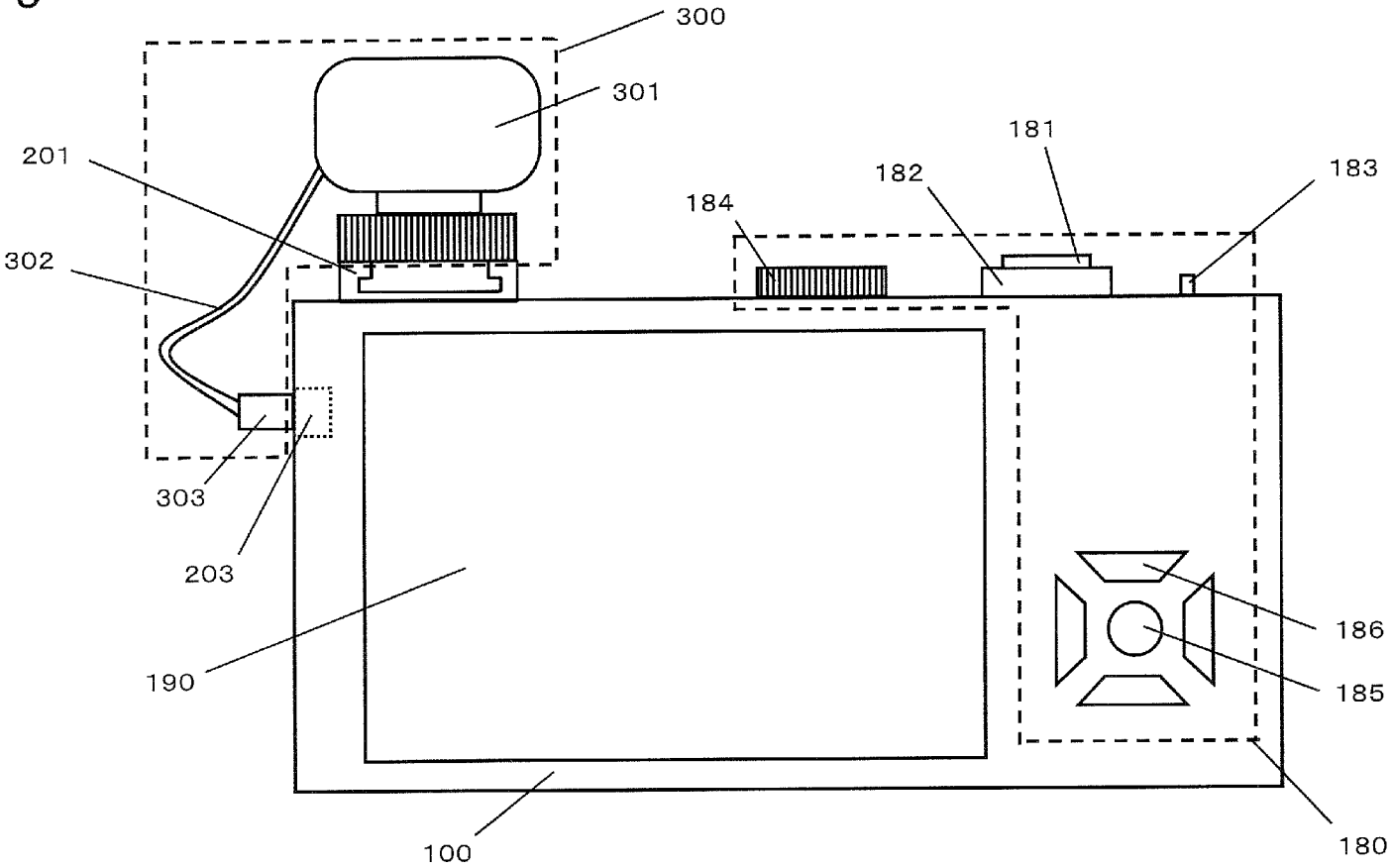
FIG. 2 is a rear view of the digital camera according to the first embodiment.

FIG. 2 is a rear view of the digital camera 100. The digital camera 100 includes the operating unit 180 that has a center button 185, a cross button 186, and the like, and a display unit 190, on a rear surface of the digital camera 100.

Figure 3:
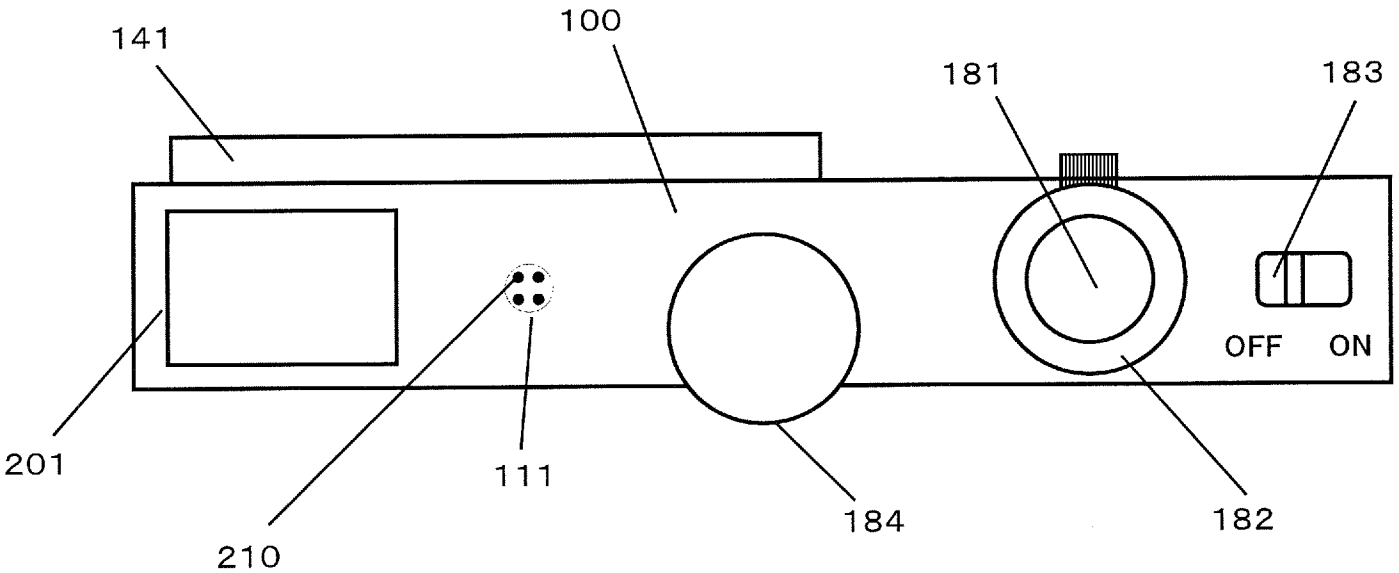
FIG. 3 is a plan view of the digital camera according to the first embodiment.

FIG. 3 is a plan view of the digital camera 100. A microphone aperture 210 is formed on an upper surface of the digital camera 100. The digital camera 100 includes an internal microphone 111 at a lower part of the microphone aperture 210.

Figure 4:
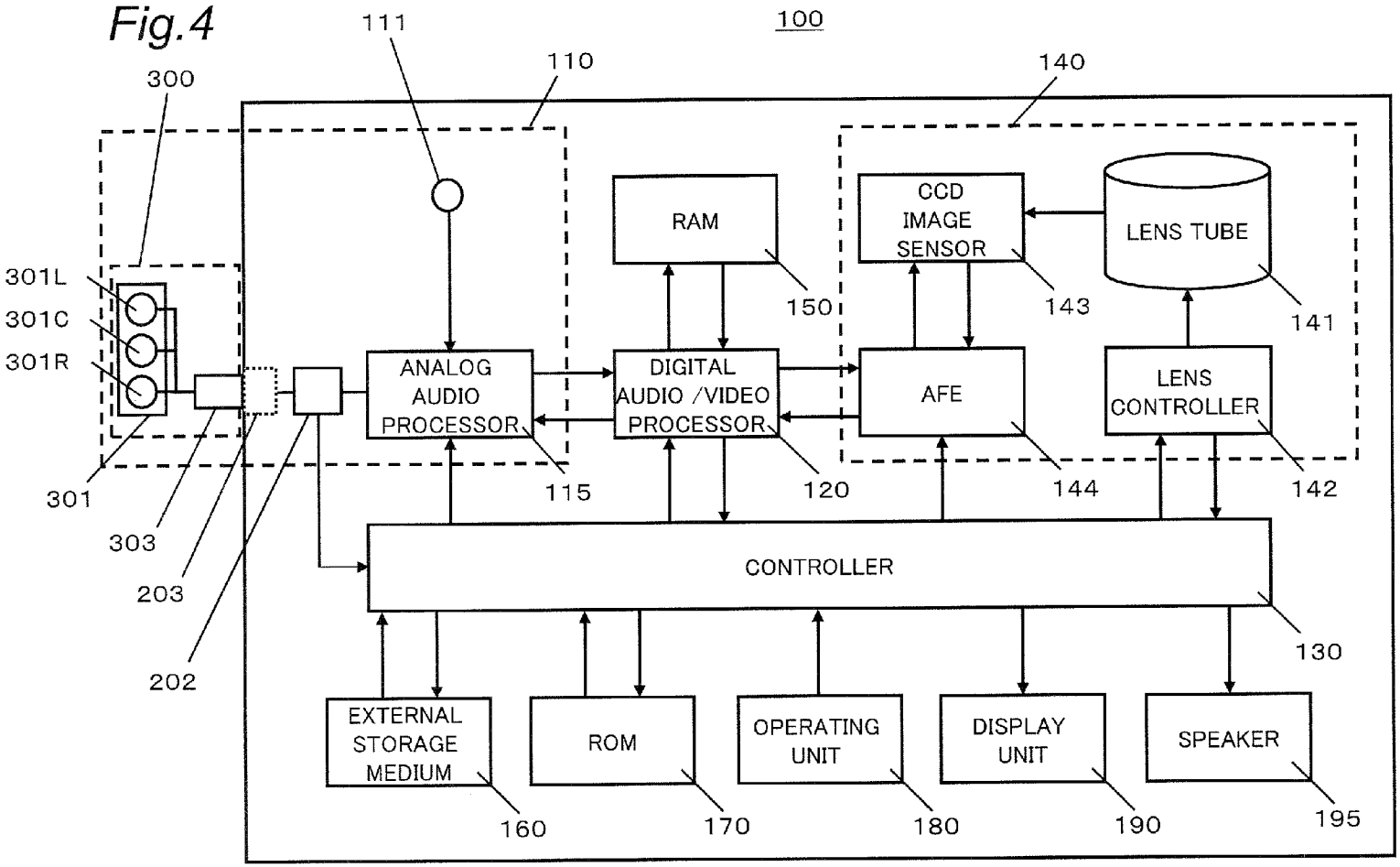
FIG. 4 is a block diagram showing an electrical configuration of the digital camera according to the first embodiment.

FIG. 4 is an electrical configuration diagram of the digital camera 100. The digital camera 100 includes an image input system 140, a sound input system 110, the digital audio/video processor 120, a controller 130, a RAM 150, an external storage medium 160, a ROM 170, the operating unit 180, the display unit 190, and a speaker 195.

The digital camera 100 generates image information and a sound signal from information obtained from outside. The image information is generated by the image input system 140. The sound signal is generated by the sound input system 110. The image information and the sound signal generated are A/D converted (analog/digital conversion), and are processed respectively by the digital audio/video processor 120.

Thereafter, the image information and the sound signal are recorded in the external storage medium 160 such as a memory card. The image information recorded in the external storage medium 160 is displayed in the display unit 190 when a user has performed a predetermined operation to the operating unit 180. The sound signal recorded in the external storage medium 160 is output from the speaker 195 upon reception of the operation of the operating unit 180 by the user.

Figure 5:
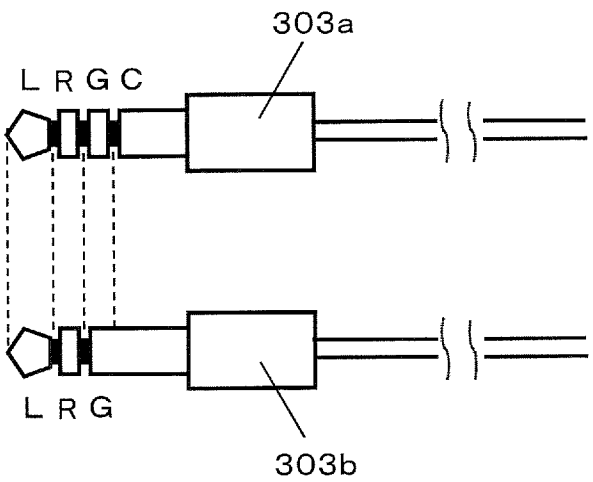
FIG. 5 is a diagram showing a detailed example of a plug according to the first embodiment.

FIG. 5 is a diagram showing a configuration example of a plug of the external microphone. The plug of the external microphone includes one that has terminals of four poles like a plug 303*a*, and the other that has terminals of three poles like a plug 303*b*. The dedicated microphone that can be connected to the digital camera 100 of the present embodiment is assumed to include the plug 303*a*. A general two-channel stereo microphone includes the plug 303*b*.

The parts shown in FIG. 1 through FIG. 5 are described in detail below.

The image input system 140 includes the lens tube 141, a lens controller 142, a CCD image sensor 143, and an AFE (analog front end) 144.

The lens tube 141 includes an optical system having plural lenses. The lens tube 141 causes a predetermined lens of the plural lenses to move by a motor driven according to a control signal notified from the lens controller 142. With this configuration, a subject image is formed, by adjusting a focus of a subject, adjusting an image angle, adjusting a quantity of incident light, and adjusting a camera shake.

The CCD image sensor 143 generates the image information by capturing the subject image formed through the lens tube 141. A large number of photodiodes are arranged two-dimensionally (in a matrix shape) on a light reception surface of the CCD image sensor 143. A primary color filter of R, G, or B is disposed corresponding to each photodiode. The primary color filters of R, G, and B are disposed in a predetermined layout structure. Light from the subject that becomes an object to be captured passes through the lens tube 141, and then forms an image on the light reception surface of the CCD image sensor 143. The formed subject image is converted into R, G, or B color information. The color information is information that changes according to a light quantity incident to each photodiode. As a result of the conversion, image information that indicates an entire subject image is generated. Each photodiode corresponds to a pixel of the CCD image sensor 143. However, the color information actually output from each photodiode is any one of primary color information of R, G, and B. Therefore, a color to be expressed by each pixel is generated based on primary color information (color, light quantity) that is output from a photodiode corresponding to each pixel and its peripheral photodiodes, in the digital audio/video processor 120 that is at a subsequent stage. The CCD image sensor 143 can generate image information of a new frame at each constant time when the digital camera 100 is in a shooting mode.

The AFE 144 performs noise suppression by a correlated double sampling to the image information that is read from the CCD image sensor 143, amplification to an input range width of an A/D converter by an analog gain controller, and an A/D conversion by the A/D converter. Thereafter, the AFE 144 outputs the image information to the digital audio/video processor 120.

The sound input system 110 includes the internal microphone 111, the jack 203, a detector 202, and the analog audio processor 115. The sound input system 110 can be connected with the external microphone 300. The external microphone 300 includes the sound pickup unit 301, the cable 302, and the plug 303. The sound pickup unit 301 includes a microphone 301L that picks up sound from a left direction, a microphone 301R that picks up sound from a right direction, and a microphone 301C that picks up sound from a front direction. The microphone 301L, the microphone 301R, and the microphone 301C are disposed at close positions and have the same sensitivities.

The plug 303 may have terminals of four poles like the plug 303*a*, for example. A terminal arrangement of the plug in this case is L (left channel), R (right channel), G (ground), and C (center channel) in order from a front end, for example. Further, the plug 303 may have terminals of three poles like the plug 303*b*, for example. A terminal arrangement of the plug in this case is L (left channel), R (right channel), and G (ground) in order from a front end, for example. Connection terminals of the jack 203 have four or more poles. In the present embodiment, the dedicated microphone corresponding to the digital camera 100 is assumed to include the plug 303*a*. The jack 203 is assumed to include the terminals L, R, G, and C corresponding to the plug 303*a* of the dedicated microphone.

The detector 202 of the digital camera 100 detects whether the plug 303 of the external microphone 300 is connected to the jack 203. A detection method can be a mechanical method or an electrical method. The mechanical method is a method such that when the plug 303 is connected to the jack 203, a front end of the plug 303 presses a switch and the detector 202 can detect a state of the press, for example. The electrical method is a method such that a predetermined wiring of which an electric resistance value changes depending on whether the plug 303 is connected to the jack 203 is prepared, and the detector 202 can detect the electric resistance value, for example.

When the detector 202 detects that the plug 303 is connected to the jack 203, the analog audio processor 115 selects and processes the input of the external microphone 300 with priority over the input of the internal microphone 111. On the other hand, when the detector 202 detects that the plug 303 is not connected to the jack 203, the analog audio processor 115 processes the input of the internal microphone 111. That is, during a period when the external microphone 300 is being connected to the digital camera 100, the external microphone 300 picks up sound, and during a period when the external microphone 300 is not being connected to the digital camera 100, the internal microphone 111 picks up sound. Therefore, the analog audio processor 115 can receive inputs of sound signals from the external microphone 300 and the internal microphone 111. However, at the same timing, the analog audio processor 115 processes the sound signal from only one of the external microphone 300 and the internal microphone 111.

The analog audio processor 115 A/D converts the processed sound signal by the A/D converter, and outputs the converted sound signal to the digital audio/video processor 120.

The digital audio/video processor 120 performs various kinds of processes to image information that is output from the AFE 144 and to a sound signal that is output from the analog audio processor 115. For example, the digital audio/video processor 120 performs a gamma correction and a white balance correction, a flaw correction, an encoding process, and the like, to the image information, according to instructions from the controller 130. Further, the digital audio/video processor 120 performs various kinds of processes to the sound signal according to instructions from the controller 130. The digital audio/video processor 120 may be realized by a hardwired electronic circuit or by a microcomputer that executes programs. The digital audio/video processor 120 may be realized as one semiconductor chip integrally with the controller 130 and the like.

The display unit 190 is disposed on the rear surface of the digital camera 100. In the present embodiment, the display unit 190 is a liquid-crystal display unit. The display unit 190 displays an image based on the image information processed by the digital audio/video processor 120. The image displayed by the display unit 190 includes a through image and a reproduction image.

The through image is an image of a frame that is continuously newly generated at each constant time by the CCD image sensor 143. Usually, when the digital camera 100 is set in the shooting mode and also when the digital camera 100 is in a waiting state of not capturing a still image or in a moving-image capturing state, the digital audio/video processor 120 generates the through image from the image information generated by the CCD image sensor 143. The user can shoot the subject by confirming a composition of the subject, by referring to the through image displayed in the display unit 190.

The reproduction image is generated by the digital audio/video processor 120 when the digital camera 100 is in a reproduction mode. The reproduction image is an image obtained by reducing a recorded image of a high pixel recorded in the external storage medium 160 or the like to an image of a low pixel by matching the image to a size of the display unit 190.

The image information of the high pixel that is recorded in the external storage medium 160 is generated by the digital audio/video processor 120 based on the image information generated by the COD image sensor 143, after the release button 181 receives a predetermined operation by the user. The speaker 195 outputs a sound signal recorded in the external storage medium 160.

The controller 130 performs an integrated control of an entire operation of the digital camera 100.

The ROM 170 stores a program for the integrated control of the entire operation of the digital camera 100, in addition to a program related to an autofocus control (AF control) and an automatic exposure control (AE control), and a light emission control of the flash 200, these programs being performed by the controller 130.

The ROM 170 stores various kinds of settings related to the digital camera 100. In the present embodiment, the ROM 170 is a flash ROM.

The controller 130 may be realized by a hardwired electronic circuit or by a microcomputer that executes programs. The controller 130 may be realized as one semiconductor chip integrally with the digital audio/video processor 120 and the like. The ROM 170 does not need to exist (as a unit separate from the controller 130) at the outside of the controller 130, and may be built inside the controller 130.

The RAM 150 functions as a work memory of the digital audio/video processor 120 and the controller 130. The RAM 150 can be realized by an SDRAM and a flash memory. The RAM 150 also functions as an internal memory for recording the image information and the sound signal.

The external storage medium 160 is an external memory that internally includes a nonvolatile recording unit such as a flash memory. The external storage medium 160 can be recorded with data such as the image information and the sound signal that are processed by the digital audio/video processor 120.

The operating unit 180 is a generic name of an operation interface such as an operation button and an operation dial that are disposed on an outer covering of the digital camera 100. The operating unit 180 receives an operation by a user. For example, the operating unit 180 corresponds to the release button 181, the zoom lever 182, the power button 183, the mode dial 184, the center button 185, and the cross button 186 that are shown in FIGS. 1, 2, and 3. The operating unit 180 notifies a signal instructing various operations to the controller 130, when receiving an operation by a user.

The release button 181 is a press button that shifts between two stages of a half-press state and a full-press state. When the release button 181 is half pressed by the user, the controller 130 performs both or either one of an AF (Auto Focus) control and an AE (Auto Exposure) control, and determines an imaging condition. In the AF control, the digital audio/video processor 120 calculates a contrast value in a predetermined region of the image information. Based on this, the controller 130 causes the lens tube 141 to be driven through the lens controller 142, and performs a feedback control to make the contrast value become maximum. As a result of the AF control, the controller 130 can obtain a focal distance to the subject to be AF controlled. As a result of the AF control, the lens tube 141 can cause the CCD image sensor 143 to form an image of the subject to be AF controlled. Subsequently, when the release button 181 is fully pressed by the user, the controller 130 causes the image information captured at a full press timing to be recorded in the external storage medium 160 or the like.

The zoom lever 182 is a lever having a wide-angle end and a telephoto end for an image angle adjustment. The zoom lever 182 is a self-return type lever that automatically returns to a center position when the operation by the user is canceled. When operated by the user, the zoom lever 182 notifies a signal to the controller 130 to instruct the lens tube 141 to be driven. That is, when the user shifts the zoom lever 182 to a wide-angle side, the controller 130 drives the lens tube 141 to be able to capture the subject image at a wide angle through the lens controller 142. Similarly, when the user shifts the zoom lever 182 to a telephoto side, the controller 130 drives the lens tube 141 through the lens controller 142 to be able to capture the subject image by telephoto.

The power button 183 is a slide button for turning ON/OFF a power supply to each unit of the digital camera 100. When the power button 183 is slid rightward by the user when the power supply is OFF, the controller 130 causes power to be supplied to each unit of the digital camera 100, and activates each unit. When the power button 183 is slid leftward by the user when the power supply is ON, the controller 130 stops the power supply to each unit of the digital camera 100.

The mode dial 184 is a rotation dial. When the mode dial 184 is turned by the user, the controller 130 switches an operation mode of the digital camera 100 to an operation mode corresponding to a current rotation position of the mode dial 184. The operation mode includes an auto shooting mode, a manual shooting mode, a scene selection mode, a reproduction mode, for example. The auto shooting mode, the manual shooting mode, and the scene selection mode are generically called the shooting mode.

The center button 185 is a press button. When the center button 185 is pressed by the user when the digital camera 100 is in the shooting mode or the reproduction mode, the controller 130 causes a menu screen to be displayed in the display unit 190. The menu screen is a screen in which the user is required to set various imaging conditions and reproduction conditions. When the center button 185 is pressed in a state that values of setting items of various conditions are selected by the user on the menu screen, the setting items are determined in these values. The determined setting is stored in the ROM 170.

The cross button 186 includes four press buttons provided in vertical and lateral directions. The user can select values of setting items of various conditions displayed on the menu screen, by pressing a button of one of the directions of the cross button 186.

The flash 200 includes a xenon tube, a capacitor, a booster circuit, and a light-emission trigger circuit. The booster circuit applies a high voltage to the capacitor according to a control signal from the controller 130. The light-emission trigger circuit causes a high voltage of a charged capacitor to be discharged according to a control signal from the controller 130, and causes a momentary light emission of a xenon gas in the xenon tube to occur. The light-emission trigger circuit causes the high voltage of the capacitor to be discharged synchronously with the imaging. With this configuration, the digital camera 100 can capture the subject that is illuminated with light generated by the light emission. That is, when the flash 200 momentarily emits light to the subject at the imaging time, the subject supplemented with brightness can be captured. The light emission by the flash 200 includes a pre-light emission and a main-light emission. The pre-light emission is a light emission before the imaging, for obtaining a light emission quantity of the flash 200 at the imaging time according to a result of determining a distance from the camera to the subject based on a degree of a reflected light quantity from the subject by the flash light emission. The main-light emission is a light emission performed synchronously with a timing of imaging based on the light emission quantity obtained by the pre-light emission.

[1-2. Correspondence Relationships]

The external microphone 300 is an example of the external sound pickup device. The microphone 301L, the microphone 301R, and the microphone 301C are examples of microphones that the sound pickup unit 301 of the external sound pickup device includes. The jack 203 is an example of the connector. The controller 130 is an example of the determiner. The digital camera 100 is an example of the sound recording device.

[2. Operation]

The operation of the digital camera 100 according to the first embodiment in the shooting mode will be described. The digital camera 100 displays the through image in the display unit 190, in a waiting state in the shooting mode or in a moving-image capturing state during a capturing of a moving image. When the external microphone 300 is connected to the digital camera 100, the digital camera 100 checks sound signals of the channels picked up by the external microphone 300, and performs a dedicated-microphone detection process of detecting whether the external microphone 300 is the dedicated microphone. A flow of an entire operation in the shooting mode is described first, and next the dedicated-microphone detection process is described below with reference to FIGS. 6 and 7.

[2-1. Operation in the Shooting Mode]

Figure 6:
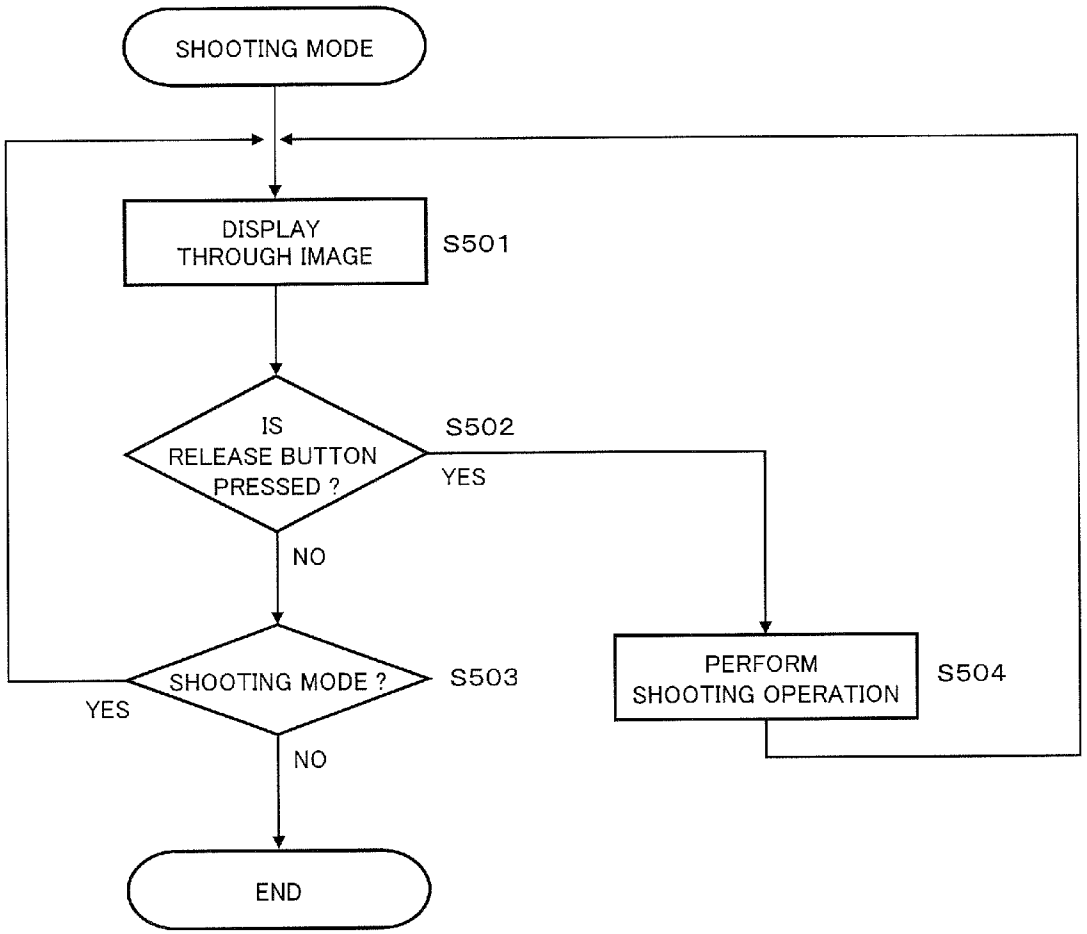
FIG. 6 is a flowchart showing a flow of an operation in a shooting mode of the digital camera according to the first embodiment.

FIG. 6 is a flowchart showing the flow of the entire operation in the shooting mode of the digital camera 100. When the power button 183 is pressed and the power is supplied, the digital camera 100 enters the shooting mode. When the mode dial 184 is pressed and the instruction to switch the reproduction mode to the shooting mode is output, the digital camera 100 also enters the shooting mode. In the shooting mode, a process shown in FIG. 6 is started. The controller 130 displays in the display unit 190 the through image that is output by the digital audio/video processor 120 (S501). Thereafter, when the detecting unit 202 detects a connection of the jack 203, the controller 130 checks output values of the terminals of the jack 203, and performs the dedicated-microphone detection process of detecting whether a device connected to the jack 203 is the dedicated microphone (S502). Next, the controller 130 determines whether the release button 181 is pressed (S502). When it is determined in step S502 that the release button 181 is pressed, the imaging operation is performed (S504). When it is determined in step S502 that the release button 181 is not pressed, the controller 130 determines whether the current operation mode is the shooting mode (S503). When it is determined in step S503 that the operation mode is the shooting mode, the process returns to step S501 as the start point of the operation in the shooting mode. When it is determined in step S503 that the operation mode is not the shooting mode, the operation in the shooting mode ends.

[2-2. Dedicated-Microphone Detection Process]

Figure 7:
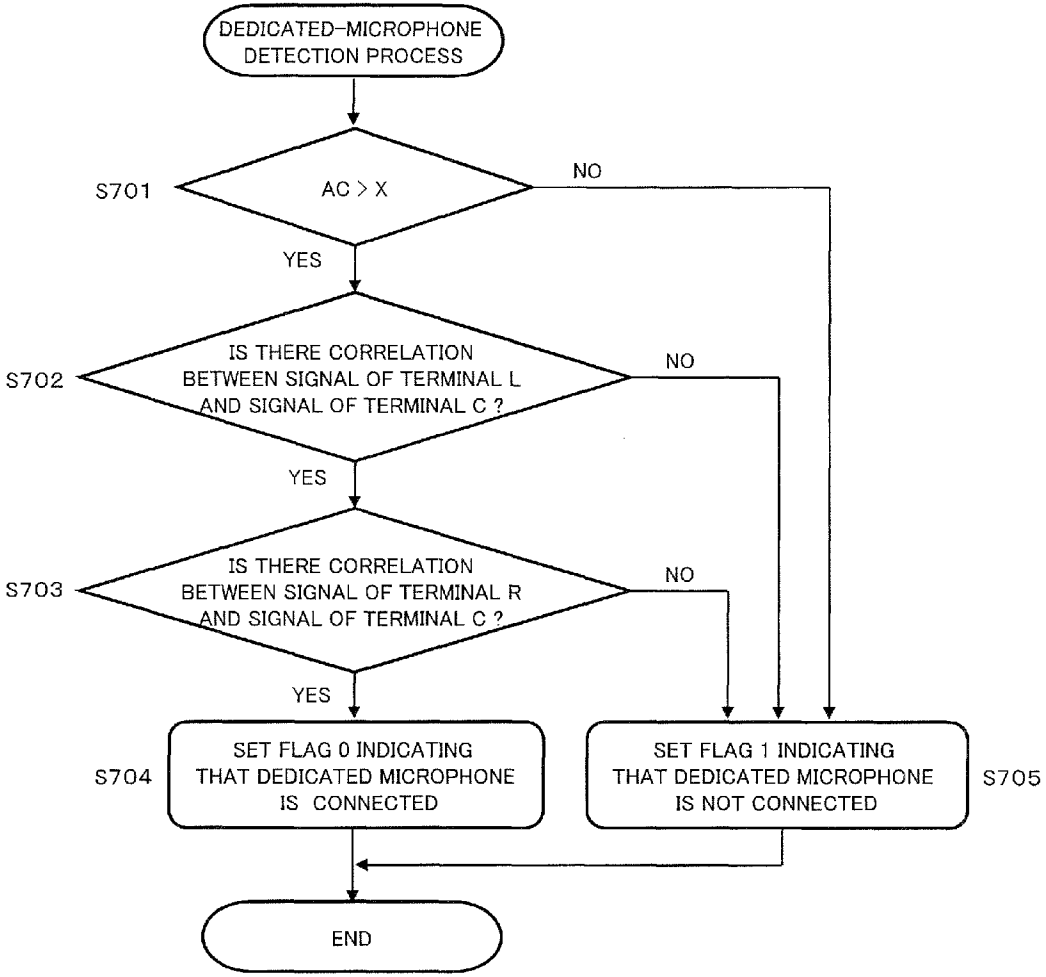
FIG. 7 is a flowchart showing a flow of an operation of a dedicated-microphone detection process of the digital camera according to the first embodiment.

FIG. 7 is a flowchart showing the dedicated-microphone detection process. The microphone 301L, the microphone 301R, and the microphone 301C are disposed at mutually close positions and have the same sensitivities, as described above. Therefore, characteristics of signals picked up by the microphone 301L, the microphone 301R, and the microphone 301C are similar to each other (that is, the signals have a mutual correlation). In the present embodiment, the dedicated-microphone detection process is performed using this characteristic. Specifically, a correlation between the sound signal from the microphone 301L, the sound signal from the microphone 301R, and the sound signal from the microphone 301C is determined, and the dedicated-microphone detection process is performed based on a result of the determination. This is described in detail below.

Figure 8:
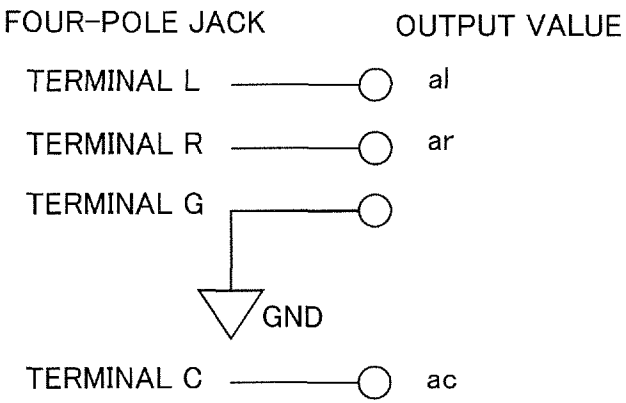
FIG. 8 is a diagram showing a relationship between a four-pole jack and output values of a sound input system of the digital camera according to the first embodiment.

When the detector 202 detects a connection in the jack 203, the controller 130 performs the dedicated-microphone detection process according to the flowchart of FIG. 7. Output values (voltages) of the terminals of the jack 203 are defined as follows. FIG. 8 is a diagram showing a relationship between the terminals of the four-pole jack of the sound input system 110 and output values of the terminals. It is assumed that an output value of the terminal L of the jack 203 is al, an output value of the terminal R of the jack 203 is ar, and an output value of the terminal C of the jack 203 is ac. The output values of the terminals are based on an output value of the terminal G of the jack 203.

An average value of the output value ac of the terminal C of the jack 203 in a period T is expressed as AC. The average value AC is defined by Formula 1, for example.

$$AC = \frac{1}{T}\int_{t_1}^{t_1+T} ac(t)dt \qquad \text{[Formula 1]}$$

The controller 130 checks whether the average value AC is larger than a predetermined threshold value X (whether "AC>X") (S701).

When "AC>X" is true in step S701, the controller 130 checks presence of a correlation between the output value al of the terminal L and the output value ac of the terminal C (S702). To determine presence of a correlation, authenticity of "$\alpha f(ac)<f(al)<\beta f(ac)$" is checked, for example. The coefficient $\alpha$ and the coefficient $\beta$ are predetermined coefficients, and the function f is a predetermined function. The coefficient $\alpha$ is 0.8, for example, and the coefficient $\beta$ is 1.2, for example. The function f is defined by Formula 2, for example.

$$f(x(t)) = \frac{1}{T_1}\int_{t_1}^{t_1+T_1}\left|x(t) - \frac{1}{T_2}\int_{t_2}^{t_2+T_2} x(t)dt\right|dt \quad \text{[Formula 2]}$$

When there is a correlation between the output value al and the output value ac, for example, when "αf(ac)<f(al)<βf(ac)" is true in step S702, the controller 130 checks presence of a correlation between the output value ar and the output value ac (S703). The controller 130 checks authenticity of "αf(ac)<f(ar)<βf(ac)", for example. The coefficient α and the coefficient β are predetermined coefficients. The function f is a predetermined function. The function f is defined by Formula 2, for example.

When there is a correlation between the output value ar of the terminal R and the output value ac of the terminal C, for example, when "αf(ac)<f(ar)<βf(ac)" is true in step S703, the controller 130 sets a flag 0 indicating that the dedicated microphone is connected (S704).

On the other hand, when "AC>X" is false in step S701, or when there is no correlation between the output value al and the output value ac (for example, when "αf(ac)<f(al)<βf(ac)" is false) in step S702, or when there is no correlation between the output value ar and the output value ac (for example, when "αf(ac)<f(ar)<βf(ac)" is false) in step S703, the controller 130 sets a flag 1 indicating that the dedicated microphone is not connected (S705).

After one of the flag setting process in step S704 and the flag setting process in step S705 ends, the dedicated-microphone detection process ends.

In the manner as described above, presence of a connection of the dedicated microphone to the digital camera 100 is detected, and the flag is set based on a result of the detection. When a setting menu is activated by the user after the flag is set by the above described dedicated-microphone detection process, the controller 130 performs a setting of selectable/unselectable of an extension function in the setting menu by referring to the set flag. The extension function is a variable function of a directional characteristic of the dedicated microphone, or a switch function of a switch between a stereo microphone recording (L/R) and a center microphone recording (C), for example. When the flag 0 indicating that the dedicated microphone is connected is being set, the controller 130 sets an item of the extension function prepared for the dedicated microphone to selectable, in the setting menu. For example, in displaying the item of the extension function to be set in the display unit 190 by operating the operating unit 180, the controller 130 switches the item of the extension function prepared for the dedicated microphone from a grayout display to an ordinary display, and at the same time, sets the item to selectable. On the other hand, when the flag 1 indicating that the dedicated microphone is not connected is being set, the controller 130 sets the extension function prepared for the dedicated microphone to unselectable. For example, in displaying the item of the extension function to be set in the display unit 190 by operating the operating unit 180, the controller 130 switches the item of the extension function prepared for the dedicated microphone to the grayout display, and at the same time, sets the item to unselectable.

Upon detecting that the plug 303 of the external microphone 300 is extracted from the jack 203, the controller 130 sets the flag 1 indicating that the dedicated microphone is not connected. Then, the controller 130 sets the extension function prepared for the dedicated microphone to unselectable.

[3. Summary]

As described above, the controller 130 of the digital camera 100 in the present embodiment detects a connection of the dedicated microphone, based on a correlation between the output signals of the terminals of the dedicated microphone. When the controller 130 detects that an apparatus connected to the jack 203 is not the dedicated microphone, the controller 130 sets the flag 1 indicating that the dedicated microphone is not connected.

When the setting menu is activated by the user, the controller 130 sets the extension function prepared for the dedicated microphone to unselectable. For example, in displaying the item of the extension function to be set by operating the operating unit 180 in the display unit 190, the controller 130 switches the item of the extension function prepared for the dedicated microphone to the grayout display, and at the same time, sets the item to unselectable. When the controller 130 detects that an apparatus connected to the jack 203 is the dedicated microphone, the controller 130 sets the flag 0 indicating that the dedicated microphone is connected. When the setting menu is activated by the user, the controller 130 sets the extension function prepared for the dedicated microphone to selectable. For example, in displaying the item of the extension function to be set by operating the operating unit 180 in the display unit 190, the controller 130 switches the item of the extension function prepared for the dedicated microphone from the grayout display to the ordinary display, and at the same time, sets the item to selectable. With this configuration, when the apparatus connected to the jack 203 is not the dedicated microphone, the user can avoid an erroneous selection of the extension function for the dedicated microphone.

[4. Effects and the Like]

As described above, the digital camera 100 in the present embodiment is the digital camera 100 to which the external microphone 300 can be connected. The digital camera 100 includes the jack 203 having plural terminals to which the external microphone can be connected, and the controller 130 that determines a type of the external microphone when the external microphone is connected to the jack 203, based on a correlation between the signals of specific terminals out of the plurality of terminals.

With this configuration, when the external microphone is connected to the jack 203, a type of the connected external microphone can be determined based on a correlation between the signals of specific terminals out of the plural terminals. Therefore, the digital camera 100 capable of more appropriately determining a type of the connected external microphone can be provided.

Further, in the present embodiment, the plurality of terminals include the terminal C, the terminal L, and the terminal R. The controller 130 determines that the connected external microphone is the specific external microphone 300, when a value concerning a correlation between a voltage of the terminal C and a voltage of the terminal L is higher than a first threshold value and also when a value concerning a correlation between a voltage of the terminal C and a voltage of the terminal R is higher than a second threshold value.

With this configuration, it can be easily determined that the connected external microphone is the specific external microphone 300, based on the value concerning the correlation between the voltage of the terminal C and the voltage of the terminal L, and the value concerning the correlation between the voltage of the terminal C and the voltage of the terminal R.

The terminal C is a terminal to which the microphone C that picks up sound from the front direction is connected. The terminal L is a terminal to which the microphone L that picks up sound from the left direction is connected. The terminal R is a terminal to which the microphone R that picks up sound from the right direction is connected.

With this configuration, it can be easily determined that the connected external microphone is the specific external microphone 300, based on a value concerning a correlation between the sound from the front direction and the sound from the left direction, and a value concerning a correlation between the sound from the front direction and the sound from the right direction.

The external microphone 300 includes the microphone C, the microphone L, and the microphone R.

With this configuration, a fact that the external microphone 300 including the microphone C, the microphone L, and the microphone R is connected can be easily determined, based on a value concerning a correlation between the sound from the front direction and the sound from the left direction, and a value concerning a correlation between the sound from the front direction and the sound from the right direction.

[Other Embodiments]

The first embodiment is described above as an exemplification of the technique disclosed in the present application. However, the technique in the present disclosure is not limited to the above exemplification, and can be also applied to an embodiment in which the first embodiment is suitably changed, replaced, added, and omitted. A new embodiment can be also provided by combining structural elements described in the first embodiment.

Other embodiments will be illustrated below.

(1) In the above embodiment, the plug 303*a* is shown as an example of the plug 303 that is included in the dedicated microphone. A terminal arrangement of the four poles of the plug 303*a* is described as L (left channel), R (right channel), G (ground), and C (center channel) in order from the front end. However, the terminal arrangement is not limited to this order. For example, the terminal arrangement of the four poles may be L (left channel), R (right channel), C (center channel), and G (ground) in order from the front end. Although the plug 303*a* is shown as an example of the plug 303 and the number of terminals of the plug is described as four poles, the number of terminals is not limited to this number.

(2) In the above embodiment, although the function f for checking a correlation in step S702 and step S703 is defined by Formula 2, the function f is not limited to be defined by this formula. For example, the function f may be defined by Formula 3. In short, an arbitrary function can be used when a correlation between the signals can be determined using this function.

$$f(x(t)) = \left\{\frac{1}{N_1}\sum_{n=t_1}^{N_1-t_1} x(t+pn)\right\} - \left\{\frac{1}{N_2}\sum_{n=t_2}^{N_2-t_2} x(t+qn)\right\} \quad \text{[Formula 3]}$$

(3) In the above embodiment, the digital camera 100 has a configuration in which the lens tube 141 is fixed. However, the lens tube 141 can be arranged to be exchangeable to the digital camera 100.

(4) In the above embodiment, although the external microphone 300 is mechanically fixed to the shoe 201, the external microphone 300 is not limited to this configuration. For example, at the time of a sound pickup by the external microphone 300, the external microphone 300 does not need to be in a state of being fixed to the shoe 201, that is, the digital camera 100. It is sufficient that the external microphone 300 is electrically connected to the digital camera 100 and that the sound signal picked up by the external microphone 300 can be input to the digital camera 100.

(5) In the above embodiment, although the sound signal that is input from the external microphone 300 is directly input to the analog audio processor 115, the input of the sound signal is not limited to this direct input. For example, the sound signal that is input from the external microphone 300 may be input to the analog audio processor 115 through a low-pass filter (LPF).

(6) In the above embodiment, although the coefficient α and the coefficient β are constant values in the determination of a correlation, the coefficients may be changed according to conditions. For example, when a level of the sound signal is low, the coefficient α and the coefficient β may be set such that ranges expressed by $\alpha f(ac)<f(al)<\beta f(ac)$ and $\alpha f(ac)<f(ar)<\beta f(ac)$ become wider. When a level of the sound signal is low, the coefficient α may be set smaller, and the coefficient β may be set larger.

(7) In the above embodiment, when the detector 202 detects a connection of the jack 203, the controller 130 performs the dedicated-microphone detection process shown in FIG. 7. However, a timing of the performance of this process is not limited to this. For example, when the setting menu is activated by the user, the controller 130 may perform the dedicated-microphone detection process shown in FIG. 7.

(8) In the above embodiment, the sound pickup unit 301 that the external microphone 300 includes has the microphone 301L, the microphone 301R, and the microphone 301C. That is, the number of microphones that the external microphone 300 includes is three. However, the number is not limited to three. For example, the number of microphones that the external microphone 300 includes may be equal to or more than four. In this case, processes corresponding to those in steps S702 and S703 in the dedicated-microphone detection process shown in FIG. 7 may be added by the increased number of microphones.

(9) In the above embodiment, the sound signal picked up by the external microphone 300 is input to the digital camera 100 through the plug 303 and the jack 203 that are electrically connected. However, this configuration may be changed as follows.

That is, the shoe 201 includes a terminal for electrical connection. The external microphone 300 is electrically connected to this terminal as well as being mechanically connected to the shoe 201. The external microphone 300 inputs the sound signal to the digital camera 100 through this terminal. The detector 202 detects that the external microphone 300 is mechanically fixed (connected) to the shoe 201 or is electrically connected to this terminal.

(10) In the above embodiment, the external microphone 300 is connected to the digital camera 100 by a wire. However, the external microphone 300 does not need to input the sound signal to the digital camera 100 through wired connection, and may input the sound signal through wireless connection. In this case, the external microphone 300 includes a microphone-side communicator, for example. Further, the sound input system 110 includes a camera-side communicator (an example of a connector). When a wireless connection is established between the microphone-side communicator and the camera-side communicator, the digital camera 100 starts receiving of the sound signal picked up by the external microphone 300. When the wireless connection is established, the detector 202 detects that the external microphone 300 is connected to the digital camera 100. The subsequent process is similar to that in the above embodiment.

(11) In the above embodiment, it is described that the digital audio/video processor 120 and the controller 130 have the functions and the configurations as described above. However, a part of the functions and the configurations that one of the digital audio/video processor 120 and the controller 130 has may be included in the other.

(12) In the above embodiment, the CCD image sensor 143 is described as an example of the imaging device. However, the imaging device is not limited to this. That is, other imaging device such as a CMOS image sensor and an NMOS image sensor can be also applied to the present technique.

(13) In the above embodiment, an example of the application of the present technique to the digital camera 100 is described. However, the present technique can be also applied to other devices that cannot handle image information so far as the sound signal can be handled. For example, the present technique can be also similarly applied to a sound recording device such as a voice recorder to which the external microphone can be connected. The present technique can be also similarly applied to a sound recording device that does not include the internal microphone.

(14) In the above embodiment, although the display unit 190 is described as a liquid-crystal display unit, the display unit 190 is not limited to the liquid-crystal display unit in the present disclosure. The display unit 190 may be an LED lamp, for example. Then, an input state of the sound signal may be indicated by a number of lighting and a color of the LED lamp.

(15) In the above embodiment, the controller 130 determines whether the connected external microphone is the specific external microphone 300, based on a correlation between the signals of specific terminals of the terminals L, R, and C. However, the content of the determination is not limited to this. For example, the controller may determine a type of the connected external microphone, based on a correlation between the signals of specific terminals of the terminals L, R, and C. Further, the controller may determine whether the connected dedicated microphone is normally functioning, based on a correlation between the signals of specific terminals of the terminals L, R, and C.

As described above, the present embodiment is described as the exemplification of the technique in the present disclosure. For this purpose, the appended drawings and the detailed description are provided.

Therefore, the constituent elements described in the appended drawings and the detailed description include not only the constituent elements that are essential to solve the problems but also the constituent elements that are not essential to solve the problems, to exemplify the above technique. Accordingly, based on the description of the not essential constituent elements in the appended drawings and the detailed description, the not essential constituent elements should never be immediately granted as essential.

Because the above embodiment is for exemplifying the technique in the present disclosure, various modifications, replacements, additions, and omissions can be performed within the range of claims or within the equivalent range of claims. Further, a new embodiment can be also provided by combining various constituent elements described in the first embodiment.

Industrial Applicability

According to the present disclosure, the sound recording device capable of more appropriately determining a type of the connected external sound pickup device can be provided. Therefore, the present disclosure can be applied to not only digital cameras but also other various kinds of sound recording devices that record sound data using an external microphone, such as movie cameras, portable telephones, and voice recorders.

What is claimed is:

1. A sound recording device to which an external sound pickup device can be connected, the sound recording device comprising:

a connector having a plurality of terminals to which the external sound pickup device can be connected; and a determiner that determines a type of the external sound pickup device when the external sound pickup device is connected to the connector, based on a correlation between signals of specific terminals of the plurality of terminals, the signals being signals changing temporally while the external sound pickup device is connected to the connector, the plurality of terminals include a first terminal and a second terminal, wherein the determiner is configured to determine the correlation between the signals by comparing a first value concerning an output signal of the first terminal and a second value concerning an output signal of the second terminal, wherein the first and second values are obtained by Formula 2, the parameter x is the voltage at the respective one of the first and second terminals, the parameter t represents time, the parameter $T_1$ represents a first duration, and the parameter $T_2$ represents a second duration.

$$f(x(t)) = \frac{1}{T_1}\int_{t_1}^{t_1+T_1}\left|x(t) - \frac{1}{T_2}\int_{t_2}^{t_2+T_2} x(t)\,dt\right| dt. \quad \text{[Formula 2]}$$

2. A sound recording device to which an external sound pickup device can be connected, the sound recording device comprising:

a connector having a plurality of terminals to which the external sound pickup device can be connected; and a determiner that determines a type of the external sound pickup device when the external sound pickup device is connected to the connector, based on a correlation between signals of specific terminals of the plurality of terminals, the signals being signals changing temporally while the external sound pickup device is connected to the connector, the plurality of terminals include a first terminal and a second terminal, wherein the determiner is configured to determine the correlation between the signals by comparing a first value concerning an output signal of the first terminal and a second value concerning an output signal of the second terminal, wherein the first and second values are obtained by Formula 3, the parameter x is the voltage at the respective one of the first and second terminals, the parameter t represents time, the parameter $N_1$ represents a first duration, the parameter $N_2$ represents a second duration, the parameter p represents a first constant value and the parameter q represents a second constant value.

$$f(x(t)) = \left\{\frac{1}{N_1}\sum_{n=t_1}^{N_1-t_1} x(t+pn)\right\} - \left\{\frac{1}{N_2}\sum_{n=t_2}^{N_2-t_2} x(t+qn)\right\}. \quad \text{[Formula 3]}$$

3. A sound recording device to which an external sound pickup device can be connected, the sound recording device comprising:

a connector having a plurality of terminals to which the external sound pickup device can be connected; and a determiner that determines a type of the external sound pickup device when the external sound pickup device is connected to the connector, based on a correlation between signals of specific terminals the plurality of terminals, the signals being signals changing temporally while the external sound pickup device is connected to the connector wherein the plurality of terminals include a first terminal L, a second terminal R, and a third terminal C, the determiner determines a first time varying voltage value [f(al)] associated with the first terminal L. a second time varying voltage value [f(ar)] associated with the second terminal R, and a third time varying voltage value [f(ac)] associated with the third terminal C, and determines that the connected external sound pickup device is a specific external sound pickup device when both the first and second time varying voltage values [f(al)], [f(ar)] are greater than a first predetermined ratio of the third time varying voltage value α*[f(ac)] and less than a second predetermined ratio of the third time varying voltage value β*[f(ac)], α and β being predetermined coefficients.

4. The sound recording device according to claim 3, wherein the determiner is configured to determine each of the first, second and third time varying voltage values by Formula 2, the parameter x is the voltage at the respective one of the first and second terminals, the parameter t represents time, the parameter $T_1$ represents a first duration, and the parameter $T_2$ represents a second duration.

$$f(x(t)) = \frac{1}{T_1}\int_{t_1}^{t_1+T_1}\left|x(t) - \frac{1}{T_2}\int_{t_2}^{t_2+T_2} x(t)\,dt\right|dt. \quad \text{[Formula 2]}$$

5. The sound recording device according to claim 3, wherein the determiner is configured to determine each of the first, second and third time varying voltage values by Formula 3, the parameter x is the voltage at the respective one of the first and second terminals, the parameter t represents time, the parameter $N_1$ represents a first duration, the parameter $N_2$ represents a second duration, the parameter p represents a first constant value and the parameter q represents a second constant value.

$$f(x(t)) = \left\{\frac{1}{N_1}\sum_{n=t_1}^{N_1-t_1} x(t+pn)\right\} - \left\{\frac{1}{N_2}\sum_{n=t_2}^{N_2-t_2} x(t+qn)\right\}. \quad \text{[Formula 3]}$$

6. A sound recording device to which an external sound pickup device can be connected, the sound recording device comprising:

a connector having a plurality of terminals to which the external sound pickup device can be connected; and a determiner that determines a type of the external sound pickup device when the external sound pickup device is connected to the connector, based on a correlation between signals of specific terminals of the plurality of terminals, the plurality of terminals include a first terminal, a second terminal, and a third terminal, and the determiner determines if a first value concerning an output signal of the first terminal and a second value concerning an output signal of the second terminal are higher than a first threshold value concerning an output signal of the third terminal and if the first value and the second value are less than a second threshold value concerning an output signal of the third terminal and determines that the connected external sound pickup device is a specific external sound pickup device when both the first and second values are higher than the first threshold value and less than the second threshold value.

7. The sound recording device according to claim 6, wherein the first terminal is a terminal to which a first external sound pickup device t picks up sound from a front direction is connected, the second terminal is a terminal to which a second external sound pickup device that picks up sound from a left direction is connected, and the third terminal is a terminal to which a third external sound pickup device that picks up sound from a right direction is connected.

8. The sound recording device according to claim 7, wherein the specific external sound pickup device includes the first external sound pickup device, the second external sound pickup device, and the third external sound pickup device.

* * * * *